United States Patent [19]

Bergstedth

[11] Patent Number: 4,804,107

[45] Date of Patent: Feb. 14, 1989

[54] DEVICE IN A VENDING MACHINE

[76] Inventor: Henry Bergstedth, Ankargatan 20, Lessebo, Sweden, S-360 50

[21] Appl. No.: 164,199

[22] Filed: Mar. 4, 1988

[51] Int. Cl.[4] ..... G07F 11/14

[52] U.S. Cl. ..... 221/12; 221/13; 221/153; 221/154; 221/227; 221/229

[58] Field of Search ..... 221/12, 13, 151, 153, 221/154, 227–229

[56] References Cited

U.S. PATENT DOCUMENTS

| | | | |
|---|---|---|---|
| 2,853,206 | 9/1958 | Uxa | 221/229 |
| 3,542,244 | 11/1970 | Dyer et al. | 221/227 |
| 3,734,344 | 5/1973 | Teichelman | 221/227 X |
| 3,840,148 | 10/1974 | Fontana | 221/153 |

FOREIGN PATENT DOCUMENTS 645707 6/1937 Fed. Rep. of Germany .

*Primary Examiner*—Charles A. Marmor
*Attorney, Agent, or Firm*—Nixon & Vanderhye

[57] ABSTRACT

A device in a vending machine in which articles are fed stepwise to a position of delivery opposite a delivery opening in the machine to be dispensed therefrom one by one, has a cover which is pivotal between a closed position in which it covers the delivery opening, and an open position in which it exposes the delivery opening to permit dispensing an article fed to the position of delivery. The device has lock in the form of an electromagnet which is adapted to lock the cover in the closed position, and a pusher in the form of an arm which is fixed to the cover and adpated, when the cover is swung from the closed position to the open position, to push the article fed to the position of delivery, at least a certain distance out of the delivery opening. A releaser is adapted to suspend the locking action of the lock when an article has been fed to the position of delivery. The release is a limit switch which is adapted, when an article has been fed to the position of delivery, to be actuated so as to interrupt the power supply to the electromagnet.

2 Claims, 3 Drawing Sheets

DEVICE IN A VENDING MACHINE

FIELD AND BACKGROUND OF THE INVENTION

The present invention relates to a device in a vending machine in which articles are fed stepwise to a position of delivery opposite a delivery opening in the machine to be dispensed therefrom one by one, said device having a cover which is pivotal between a closed position in which it covers said delivery opening, and an open position in which it exposes the delivery opening to permit dispensing an article fed to the position of delivery, locking means adapted to lock the cover in the closed position, and a pusher which is adapted when the cover pivots from the closed position to the open position, to push the article fed to the position of delivery, at least a certain distance out of the delivery opening.

SUMMARY OF THE INVENTION

The object of the present invention is to provide a device which facilitates dispensing or withdrawing articles from a vending machine of the type described above, but yet is tamper-proof.

According to the invention, this object is achieved by means of a device which is of the type described above and characterized in that the pusher comprises an arm fixed to the pivotal cover for pivotal movement together with the cover, said locking means comprising an elctromagnet having a part, such as an armature, fixed to the cover and movable together with the cover, and another part, such as a coil, fixedly mounted on the machine, said release means being adapted to suspend the locking action of the locking means when an article has been fed to the position of delivery, and said release means comprising a limit switch which is adapted, when an article has been fed to the position of delivery, to be actuated in order to interrupt the current supply to the electromagnet.

In a preferred embodiment, a cover plate is arranged in the path of feed of the articles in a location which the articles will occupy just before reaching the position of delivery, the cover plate serving as a screen between the articles and the delivery opening, and the cover plate is adapted, by means of the article fed to the position of delivery, to be swung apart so as to remove the screen between the articles and the delivery opening and to actuate the release means for suspending the locking action of the locking means.

BRIEF DESCRIPTION OF THE DRAWINGS

The invention will now be described in greater detail with reference to the accompanying drawings.

DESCRIPTION OF ILLUSTRATED EMBODIMENT

Figure 1:
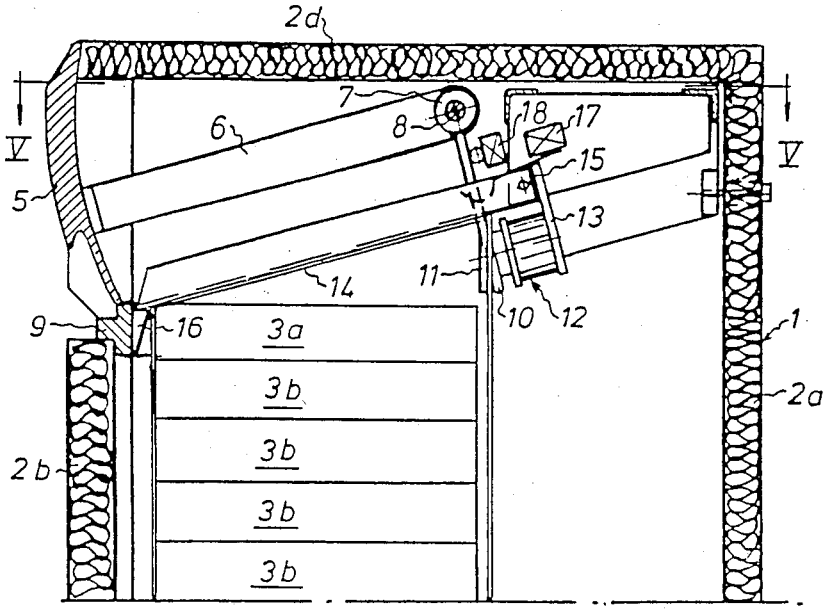
FIG. 1 is a vertical sectional view showing the upper part of a vending machine provided with a device according to the present invention which is illustrated in a starting position.

In the drawings, there is shown a vending machine 1 having a device according to the present invention. In the illustrated embodiment, the vending machine 1 is a refrigerator or freezer and therefore has insulated walls

*2a, 2b, 2c, 2d.* The vending machine 1 has two compartments which are disposed beside each other and in which articles *3a, 3b* in the form of food-containing boxes or cartons are stacked on each other. The stacks of articles *3a, 3b* are each supported on a shelf (not shown) the vertical position of which is adjustable in a per se known manner, which is not shown in more detail. To allow such vertical adjustment of the shelf, each shelf engages with an endless screw which is rotatable by means of a motor.

Figure 2:
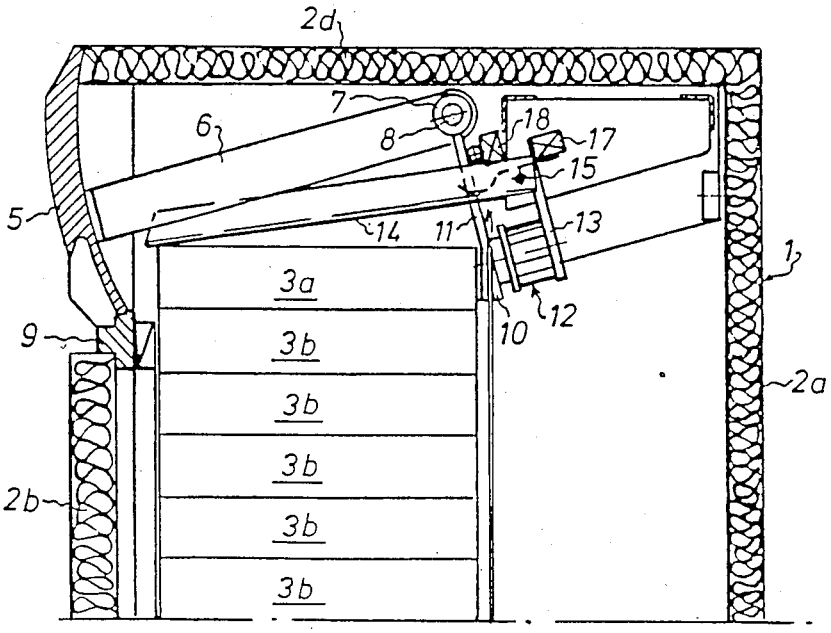
FIGS. 2–4 are similar to FIG. 1 but show the device in different positions for dispensing an article.
Figure 3:
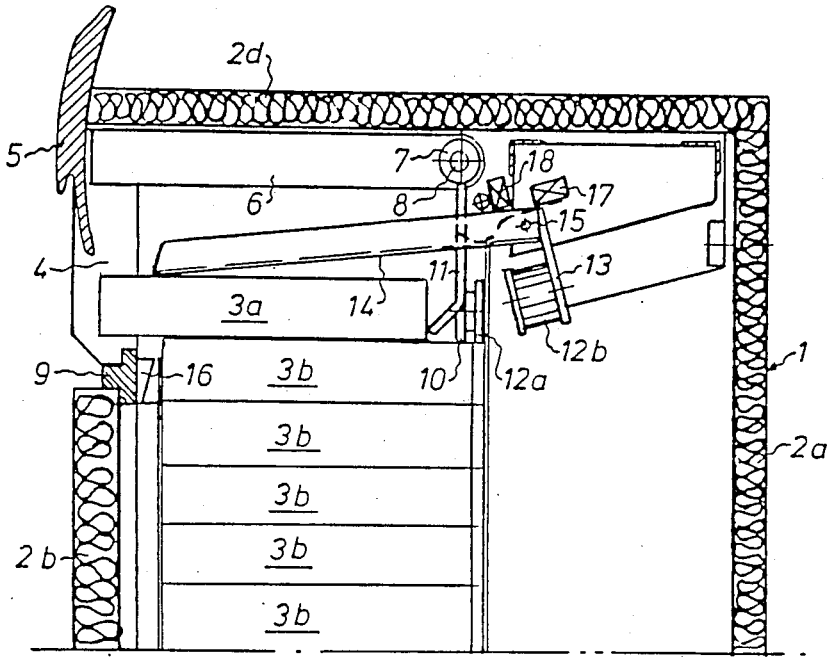
Figure 4:
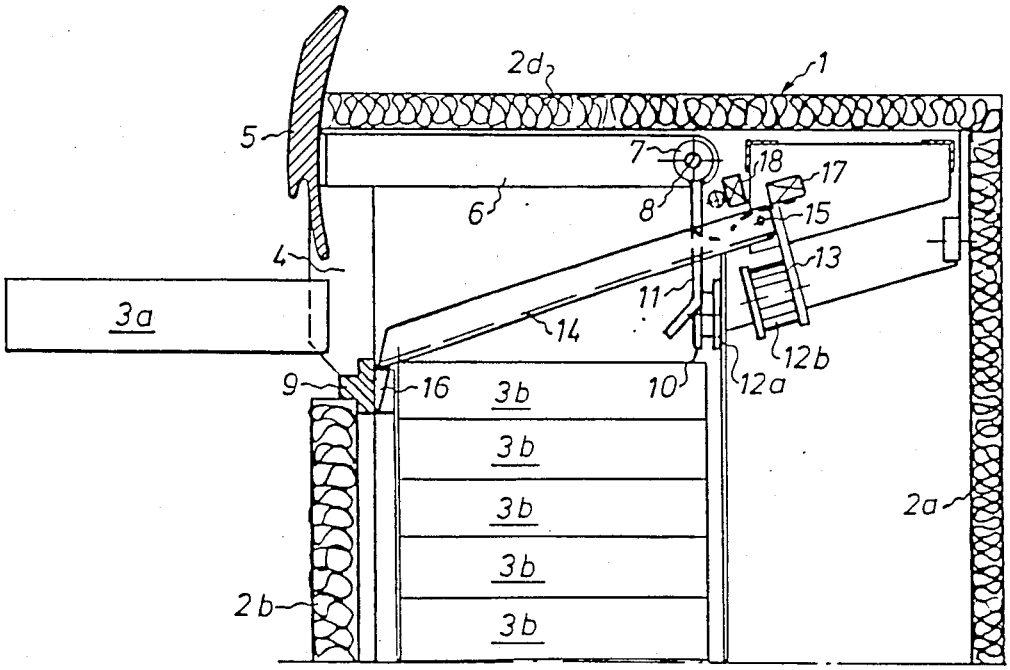
Figure 5:
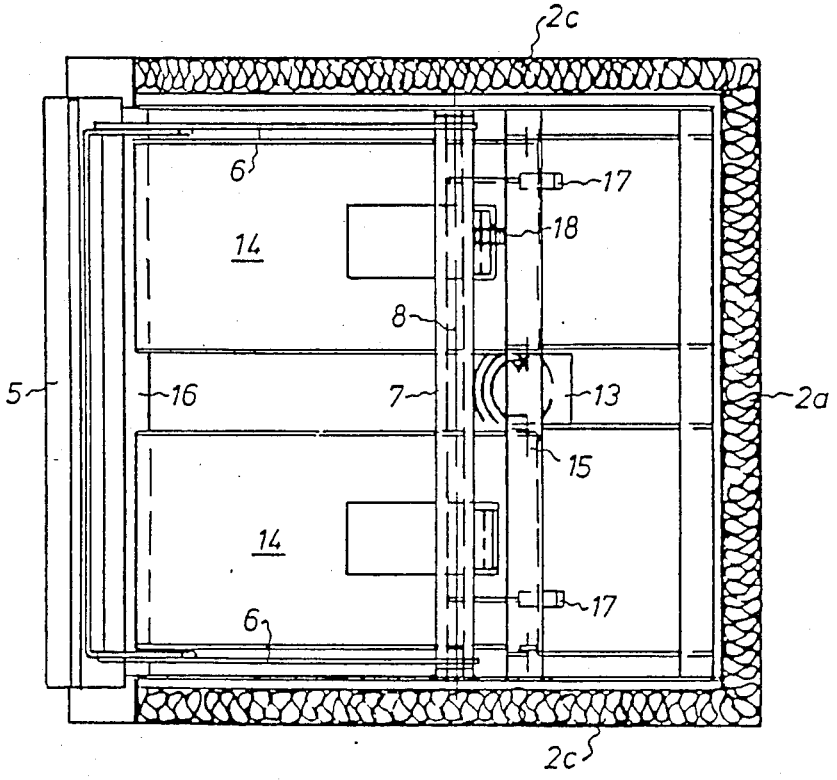
FIG. 5 is a sectional view taken along the line V—V in FIG. 1.

At its front wall *2b,* the vending machine 1 has a delivery opening 4 for dispensing articles *3a, 3b* from the two compartments. A cover 5 is arranged in front of the delivery opening 4. The cover 5 is rigidly connected to first ends of two shanks 6 extending along the two side walls *2c* of the vending machine 1. At the opposite ends, the shanks 6 are each rigidly connected to one end of a horizontal transverse tube 7. A shaft 8 fixed to the side walls *2c* extends through the tube 7. The cover 5 thus is pivotal between a closed position (FIGS. 1 and 2) in which it engages a sealing strip 9 and covers the delivery opening 4, and an open position (FIGS. 3 and 4) in which it exposes the delivery opening 4.

Between the two compartments, the tube 7 carries an arm 10 and, approximately opposite the stack in each shaft, an arm 11. The arms 10 and 11, which extend at substantially right angles to the shanks 6, are rigidly fixed to the tube 7 and, thus, are rotated together with it.

The intermediate arm 10 carries an armature *12a* which is part of an electromagnet 12 whose coil *12b* is carried by a holder 13 attached to the rear wall *2a.*

The two outer arms 11 are bent at their lower end portions at such an angle that these end portions, in the closed position of the cover 5, extend substantially vertically downwardly at the rear part of the respective shaft.

A cover plate 14 is arranged over each compartment. The two cover plates 14 are pivotal about a horizontal transverse shaft 15 fixed in the side walls *2c.* In the starting position of the device (FIG. 1), the cover plates 14 abut by their own weight on a lug 16 provided inwardly of and slightly below the sealing strip 9. Above each cover plate 14, there is provided a limit switch 17 cooperating with the cover plate. In conjunction with one of the arms 11, there is provided a limit switch 18 cooperating with said arm.

The function of the vending machine 1 and, hence, of the device according to the present invention will now be described in more detail.

In the starting position shown in FIG. 1, the cover 5 is closed, the electromagnet 12 is activated so as to maintain the cover 5 locked in the closed position, and the limit switch 18, by its cooperation with the arm 11, is activated for exposing a coin slot (not shown) in the front wall *2b* of the vending machine 1. When a coin has been inserted and an article selected by pushing a button corresponding to one of the compartments at the front wall of the machine, the motor associated with the shelf in this compartment is started for rotating the associated screw and moving the stack of articles *3a, 3b* upwardly from the starting position shown in FIG. 1.

When the stack is moved upwardly, it will lift the cover plate 14 pivoting about its shaft 15. When the stack has reached the position shown in FIG. 2, in which the topmost article *3a* of the stack has reached the delivery opening 4, i.e. reached with its bottom portion a level slightly above the upper edge of the sealing strip 9, the lower end portion of the arm 11 being located behind the topmost article 3*a*, the cover plate 14 has been swung to such an extent that it makes the limit switch 17 inoperative. This then interrupts the power supply to the motor, and the movement of the stack is interrupted in the position shown in FIG. 2. When the limit switch 17 is made inoperative, it will at the same time interrupt the power supply to the electromagnet 12 which thus is made inoperative, whereby the cover 5 is unlocked and opened.

When the cover 5 is opened, the arm 11 is pivoted together with the cover and pushes the topmost article 3*a* a certain distance out of the delivery opening 4 (FIG. 3), such that it will be easy to grasp and withdraw. When the cover 5 is opened, the limit witch 18 is rendered inoperative, the coin slot being blocked and the insertion of coins made impossible, such that none of the motors can be started.

When the topmost article 3*a* is withdrawn, the cover plate 14 will drop back to its starting position into engagement with the lug 16 (FIG. 4), the limit switch 17 being activated so as to close the current supply circuit to the electromagnet 12 and make it operative, and so as to close the current supply circuit to the motor, such that it is again started after the insertion of a coin or coins.

When the cover 5 has finally been closed and locked in the closed position by the electromagnet 12, the limit switch 18 is again activated in order to expose the coin slot. The starting position shown in FIG. 1 has thus again been attained, and renewed withdrawal of an article can be carried out in the manner described above.

The control circuits and electric circuits required for achieving the above-described functions initiated by the limit switches 17 and 18 are of a known type and make themselves no part of the present invention. These circuits therefore are not described in more detail in this context.

That which is claimed is:

1. A device in a vending machine in which articles are fed stepwise to a position of delivery opposite a delivery opening in the machine to be dispensed therefrom one by one, said device having a cover which is pivotal between a closed position in which it covers said delivery opening, and an open position in which it exposes the delivery opening to permit dispensing an article fed to the position of delivery, locking means adapted to lock the cover in the closed position, and a pusher which is adapted when the cover pivots from the closed position to the open position, to push the article fed to the position of delivery, at least a certain distance out of the delivery opening, said pusher comprising an arm fixed to the pivotal cover for movement together with the cover, said locking means comprising an electromagnet having an armature fixed to the cover and movable together with the cover, and a coil fixedly mounted on the machine, a release means being adapted to suspend the locking action of the locking means when an article has been fed to the position of delivery, and said release means comprising a limit witch which is adapted, when an article has been fed to the position of delivery, to be actuated in order to interrupt current supply to the electromagnet.

2. A device as claimed in claim 1 wherein a cover plate is arranged in the path of feed of the articles in a location which the articles will occupy just before reaching the position of delivery, said cover plate serving as a screen between the articles and the delivery opening, said cover plate by means of the article fed to the position of delivery being able to swing apart so as to remove the screen between the articles and the delivery opening and to actuate the release means for suspending the locking action of the locking means.

* * * * *